US006966463B1

(12) United States Patent
Yeager et al.

(10) Patent No.: US 6,966,463 B1
(45) Date of Patent: Nov. 22, 2005

(54) LIQUID DISPENSER

(75) Inventors: Robert H. Yeager, Twinsburg, OH (US); John P. Cichello, Wooster, OH (US); Ken Foran, Wooster, OH (US)

(73) Assignee: Joseph S. Kanfer, Richfield, OH (US)

( * ) Notice: Subject to any disclaimer, the term of this patent is extended or adjusted under 35 U.S.C. 154(b) by 142 days.

(21) Appl. No.: 10/702,411

(22) Filed: Nov. 7, 2003

(51) Int. Cl.[7] ..... B67D 5/06
(52) U.S. Cl. ..... 222/181.3; 222/183; 222/192
(58) Field of Search ..... 222/105, 181.2, 222/181.3, 183, 192

(56) References Cited

U.S. PATENT DOCUMENTS 1,731,545 A * 10/1929 Sanders ..... 222/181.3
3,540,630 A * 11/1970 Brown et al. ..... 222/181.2
4,146,156 A * 3/1979 Cassia ..... 222/181.2
4,159,788 A * 7/1979 Doyel ..... 222/181.2
4,548,340 A * 10/1985 Messer ..... 222/181.2
5,033,657 A * 7/1991 Whittington ..... 222/181.2
5,044,522 A * 9/1991 Roig et al. ..... 222/181.3
D491,006 S * 6/2004 Yeager et al. ..... D6/511

* cited by examiner

*Primary Examiner*—Kenneth Bomberg
(74) *Attorney, Agent, or Firm*—Renner, Kenner, Greive, Bobak, Taylor & Weber

(57) ABSTRACT

A dispenser for dispensing fluid from a container securely mounted to a wall surface including a base mounting plate and a cover attached to the base mounting plate; the cover is capable of movement between open and closed positions relative to the base mounting plate; a mini-shelf unit having a main body portion and a hook portion is attached to the base mounting plate via a connecting bracket having an L-shape; the main body portion and hook portion are segregated by a hump, and the main body portion slopes downwardly toward the hook portion; the hook portion is provided with an upwardly extending hook; and liquid received on the mini-shelf unit drains around the hump, and into a hole provided in the hook portion.

18 Claims, 6 Drawing Sheets

LIQUID DISPENSER

RELATED PATENT APPLICATIONS

This invention is the subject of a design application filed May 19, 2003 as Ser. No. 29/181,933 entitled Shelf Assembly.

BACKGROUND OF THE INVENTION

The present invention relates, in general, to wall-mounted liquid dispensers and, in particular, to such a dispenser with a removable shelf unit for receipt of various articles attached mini-shelf unit.

DESCRIPTION OF THE BACKGROUND ART

There are many dispensers known in the art for dispensing liquid such as soap or other viscous liquid. These dispensers are used in confined spaces such as bathrooms and showers in bathrooms. Therefore, dispensers have been equipped with other features to save space. For example, dispensers have been equipped with toothbrush holders, and ledges and pockets for holding various toiletries. However, these features are often integrally formed with the dispenser. Because it is impossible to remove these features from the dispenser without causing damage, it has been necessary to manufacture two dispensers: one with and one without these features. Consequently, there is a need for a shelf unit that can be removably attached to a dispenser. Such a shelf unit could provide a ledge for holding various toiletries as well as other features, and allow the dispenser to be adapted for use with and without the shelf unit.

SUMMARY OF THE INVENTION

In general, the present invention contemplates a dispenser capable of being securely mounted to a wall surface for dispensing fluid from a container, comprising: a base mounting plate having a side wall; a cover having a front fascia, wherein said cover is attached to said base mounting plate, and is capable of movement between open and closed positions relative to said base mounting plate; a mini-shelf unit having a main body portion and a hook portion, said main body portion including a first top surface and a first bottom surface, and said hook portion including a second top surface; a hole provided in said second top surface; a hook extending outwardly from the distal end of said hook portion; a hump effectively dividing said first stop surface and said second top surface, wherein said hump smoothly transitions into said second top surface; a connecting bracket having an L-shape formed from a first leg member and a second member, wherein said mini-shelf unit is removably attached to said connecting bracket, and said connecting bracket is clamped to said side wall of said base mounting plate; first and second pairs of posts, wherein said first pair and said second pair of posts extend outwardly from said first bottom surface; two sets of holes provided in said first leg member, wherein one set of holes is adapted to accommodate said first pair of posts to orient said mini-shelf unit in a right-hand configuration with respect to said dispenser and the other set of holes is adapted to accommodate said second pair of posts to orient said mini-shelf unit in a left-hand configuration with respect to said dispenser.

BRIEF DESCRIPTION OF PREFERRED EMBODIMENTS

Figure 1:
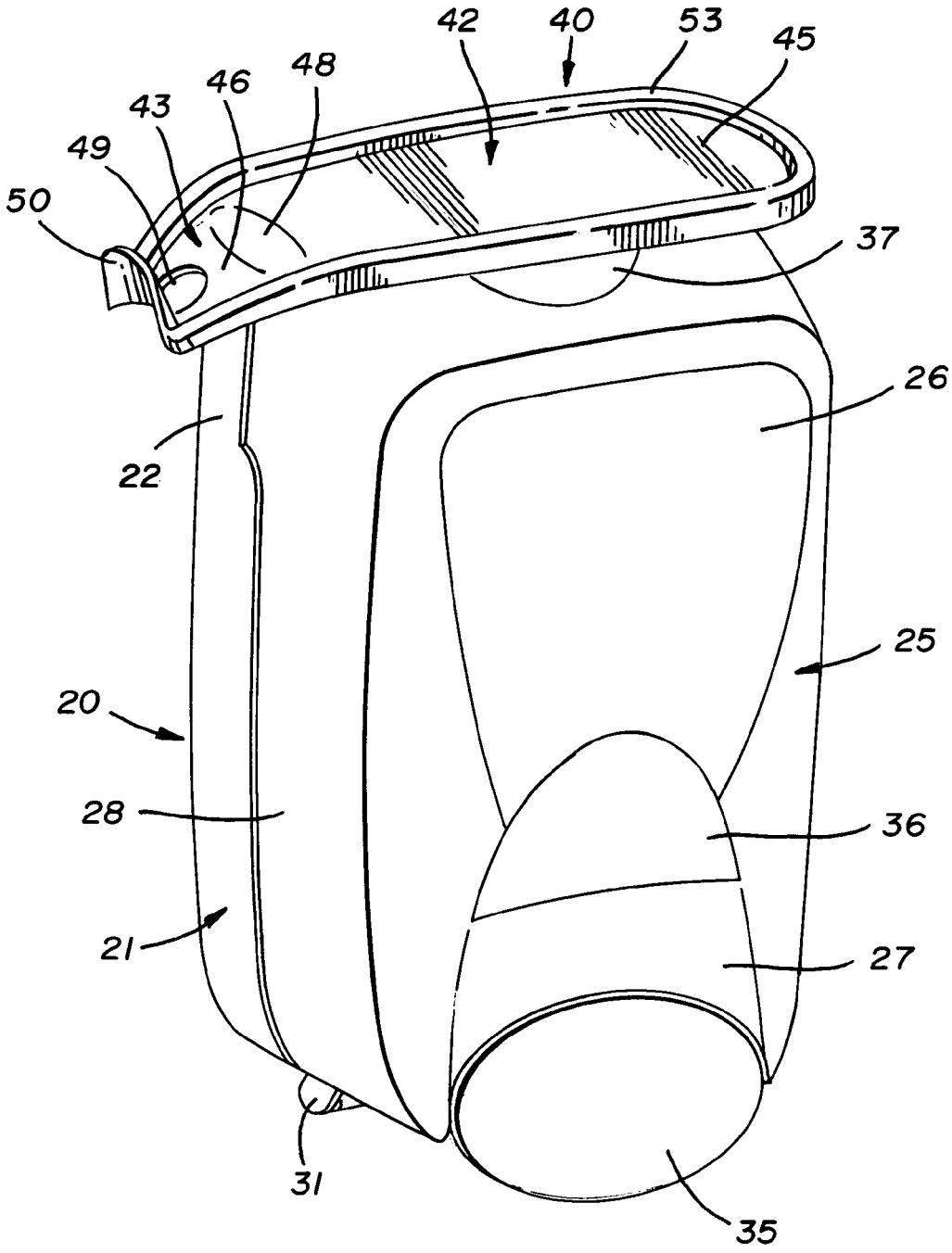
FIG. 1 is a perspective view of the dispenser and mini-shelf unit of the present invention.
Figure 2:
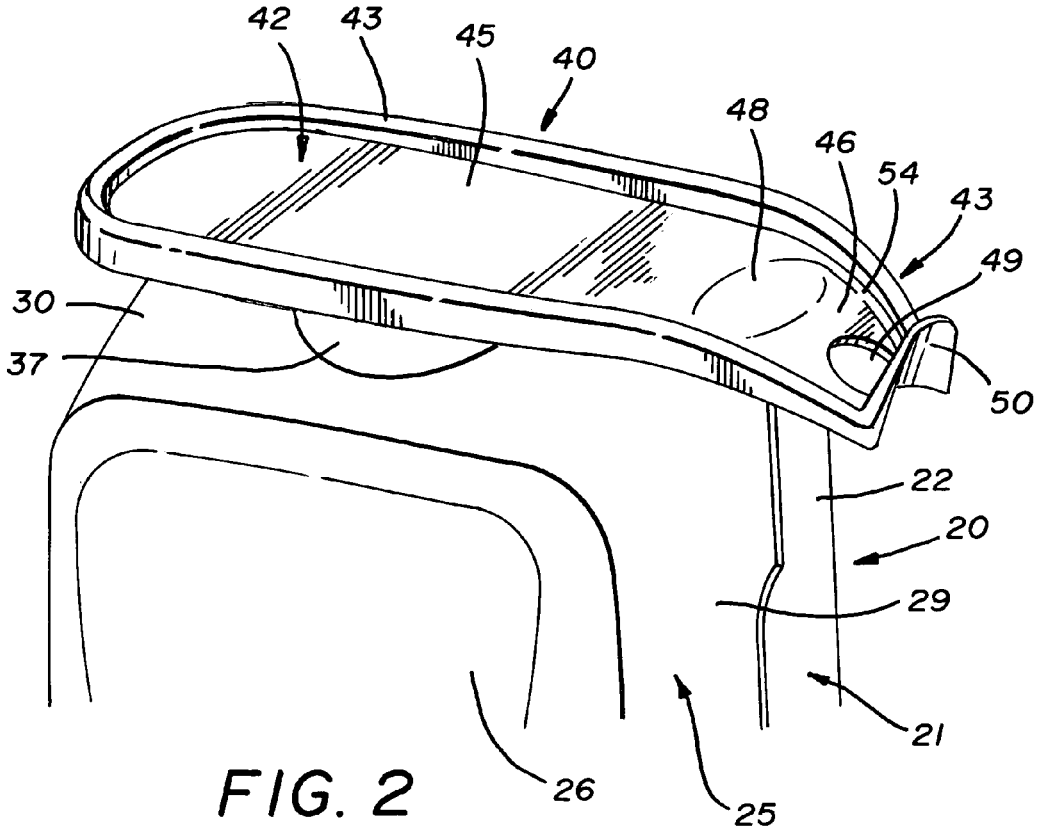
FIG. 2 is another perspective view of the dispenser and mini-shelf unit of the present invention.
Figure 9:
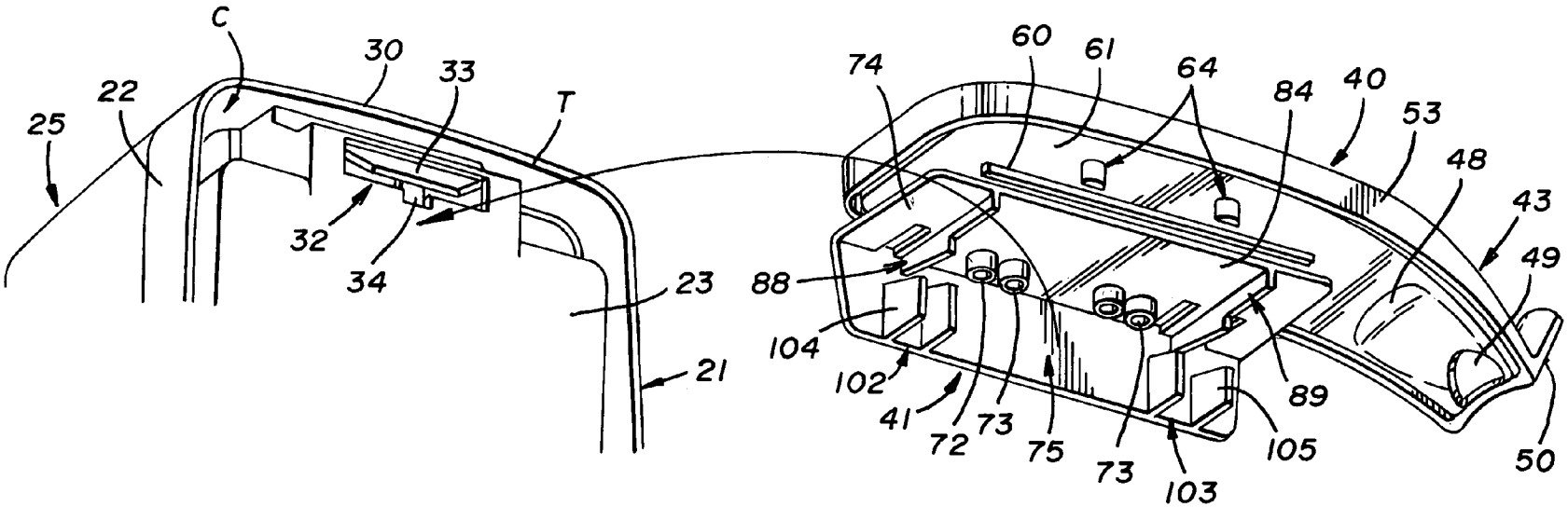
FIG. 9 is an exploded view of the dispenser and mini-shelf unit attached to the connecting bracket.

Referring first then to FIGS. 1 and 2 of the drawings, the dispenser is generally indicated by the numeral 20, and includes a base mounting plate 21 and a cover 25. As seen in FIG. 9, the base mounting plate 21 includes a side wall 22 and back surface 23. The side wall 22 extends around the back surface 23, and a channel C is formed therebetween. The cover 25 has a front fascia respectively divided into upper and lower front facia portions 26 and 27. The cover 25 also includes lateral side surfaces 28 and 29, a top surface 30, and a bottom surface (not shown). The cover 25 is mounted to the base mounting plate 21 via hinge connection 31. As a result, the cover 25 is capable of pivotal movement between open and closed positions relative to base mounting plate 21.

Referring to FIG. 9 of the drawings, the base mounting plate 21 and cover 25 are fastened together using the locking mechanism 32. The locking mechanism 32 is composed of a latch 33 and an articuluable catch 34. The articuluable catch 34 is operatively connected to the base mounting plate 21, and, therefore, is moveable between a release position and a locking position. The latch 33 extends outwardly from the top surface 30 of the cover 25, and when in a locking position, the articuluable catch 34 interfaces with the latch 33 to effectively fasten the cover 25 in a locking position with respect to the base mounting plate 21. The locking mechanism 32 can be unlocked by articulation of the articuluable catch 34.

Received with the interior of the dispenser 20 is a container of liquid (not shown) filled with liquid. Preferably, the container is either a collapsible bag or bottle. The dispenser 20 is equipped with a means for dispensing (not shown) actuated through depression of the pressure bar 35. As such, the pressure bar 35 can be actuated by depressing the pressure bar 35 using the hand of a user. Resultantly, a predetermined amount of liquid will be dispensed into the hand of the user from a nozzle extending through the bottom surface of the cover 25 via actuation of the pressure bar 35.

A sight window 36 is provided on the lower front fascia 27 of cover 25 to allow the user to gauge the liquid level inside the collapsible bag or bottle. Another sight window 37 is provided in the top surface 30 of the cover 25 to allow the user to further gauge the level of the liquid in the collapsible bag or bottle. Furthermore, the back surface 23 of the base mounting plate 21 is provided with a plurality of keyhole-shaped apertures (not shown) adapted to receive the heads of fasteners. The keyhole-shaped apertures and fasteners allow the user to securely mount the dispenser 20 to a wall surface. Alternatively, the dispenser can be mounted using adhesive or any other desired mounting means.

Figure 3:
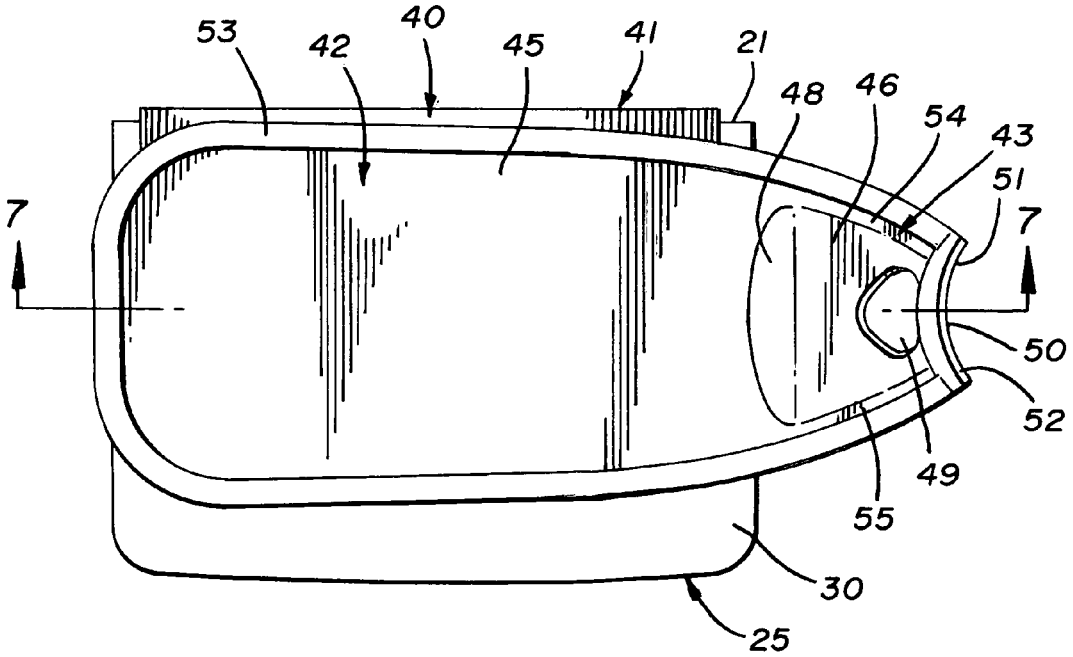
FIG. 3 is a top plan view of the dispenser and mini-shelf unit of the present invention.
Figure 7:
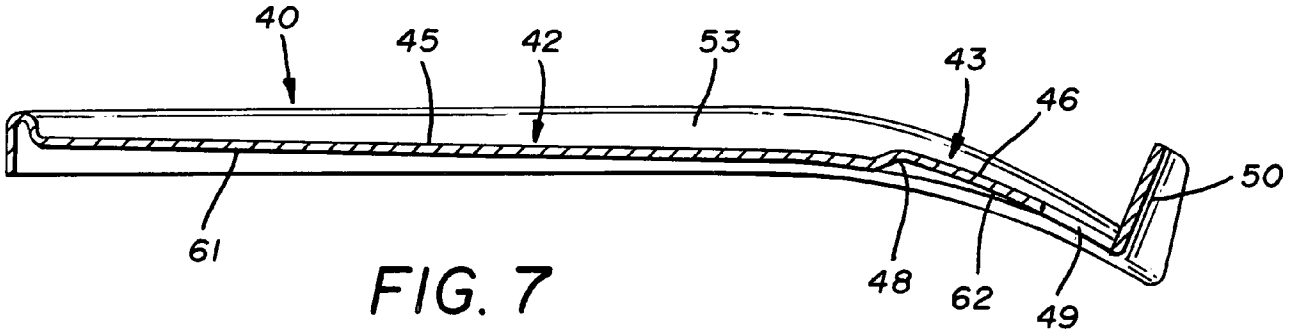
FIG. 7 is a cross-sectional view of the mini-shelf unit along Line 7—7 of FIG. 3.

Recognizing that the dispenser 20 has commercial and residential uses, the dispenser 20 is equipped with a mini-shelf unit 40. As best seen in FIGS. 2, 3, and 7, the mini-shelf unit 40 is attached to the dispenser 20 using a connecting bracket 41, and has a main body portion 42 and hook portion 43. The main body portion 42 and hook portion 43 include a first top surface 45 and second top surface 46, respectively, and these surfaces are effectively segregated by the hump 48. The hump 48 protrudes upwardly from the first top surface 45 of the main body portion 42, and thereafter smoothly transitions into the second top surface 46 of the hook portion 43.

The first top surface 45 of the main body portion 42 slopes downwardly to the hump 48. Furthermore, the second top surface 46 of the hook portion 43 includes a hole 49, and curves downwardly from the hump 48 to a hook 50. The hook 50 extends upwardly at an angle from distal end of the hook portion 43, and has first and second flanks 51 and 52 with a contoured shape extending therebetween. The hook 50 can be used for hanging wash-cloths or the like.

Tracing the perimeters of the first top surface 45 and the second top surface 46 of the main body portion 42 and hook portion 43, respectively, is a rim or side wall 53. The rim 53 extends around the mini-shelf unit 40 from the first flank 51 to the second flank 52 of the hook 50. However, the hump 48 does not extend from the opposite sides of the rim 53 across the first top surface 45 and second top surface 46 of the mini-shelf unit 40. Instead, first and second passages 54 and 55 are located around the periphery of the hump 48 adjacent to the opposite sides of the rim 53. The first and second passages 54 and 55 are used to link the first top surface 45 with the hole 49.

Any liquid received on the main body portion 42 is compelled by the slope of the first top surface 45 to flow toward and around the hump 48, and into the first and second passages 54 and 55. From the first and second passages 54 and 55, the liquid is ultimately emptied into the hole 49. For example, when bar soap is placed on the main body portion 42, the hump 48 prevents bar soap from sliding off the mini-shelf unit 40, and the side passages 54 and 55 allow liquid to be drained from the first top surface 45 into the hole 49.

The bottom surface 61 of main body portion 42 is provided with various reinforcing ribs 60. The reinforcing ribs 60 longitudinally traverse the main body portion 42, and abut the connecting bracket 41 when the mini-shelf unit 40 is removably attached to the connecting bracket 41. To further enhance the slope of the first top surface 45 when the mini-shelf unit 40 is attached to the connecting bracket 41, the reinforcing ribs 60 are inclined. That is, the reinforcing ribs 60 have a varied height along the longitudinal length of the main body portion 42, and gradually transitioning between the highest elevation which is the farthest from the hook portion 43 and the lowest elevation which is the nearest to the hook portion 43.

Also provided on the bottom surface 61 are outwardly extending first and second pairs of posts 64 and 65. The distal ends of the individual posts are indented in the same manner. That is, the distal ends of the individual posts are cut away to form connection nubs having a half-circle shape in cross-section. For example, the distal ends of the individual posts form first and second connection nub pairs 66 and 67. Depending on the orientation of the mini-shelf unit 40 with respect to the connecting bracket 41, the first connection nub pair 66 is inserted in a set of half-circle holes 73 and the second connection nub pair 67 is inserted in a set of half-circle holes 72. The sets of holes 72 and 73 are provided in the connecting bracket 41, and are oriented in opposite directions. As will be discussed below, the sets of holes 72 and 73 allow the mini-shelf unit 40 to be removably attached to the connecting bracket 41.

The connecting bracket is L-shaped and is composed of a first leg member 74 and a second leg member 75. The first leg member 74 and the second leg member 75 have interior surfaces 84 and 85, respectively. The sets of holes 72 and 73 are provided through the first leg member 74, and respectively through sets of columns 76 and 77 integrally attached to the first leg member 74. The sets of holes 72 and 73, and sets of columns 76 and 77 have overlapping placement with respect to one another. That is, one hole of set 72 is adjacent one hole of set 73, and the other hole of set 72 is adjacent the other holes of set 73. The sets of columns 76 and 77 are arranged in a similar manner. For example, one column of set 76 is adjacent one hole of set 77, and the other column of set 76 is adjacent one hole of set 77. As seen in FIG. 9, each individual column of the sets of columns 76 and 77 are cylindrically-shaped and extend outwardly from the interior surface 84. As will be discussed below, the distal end surfaces of the individual columns of the sets of columns 76 and 77 are contoured to accommodate the top surface 30 of cover 25.

Figure 10:
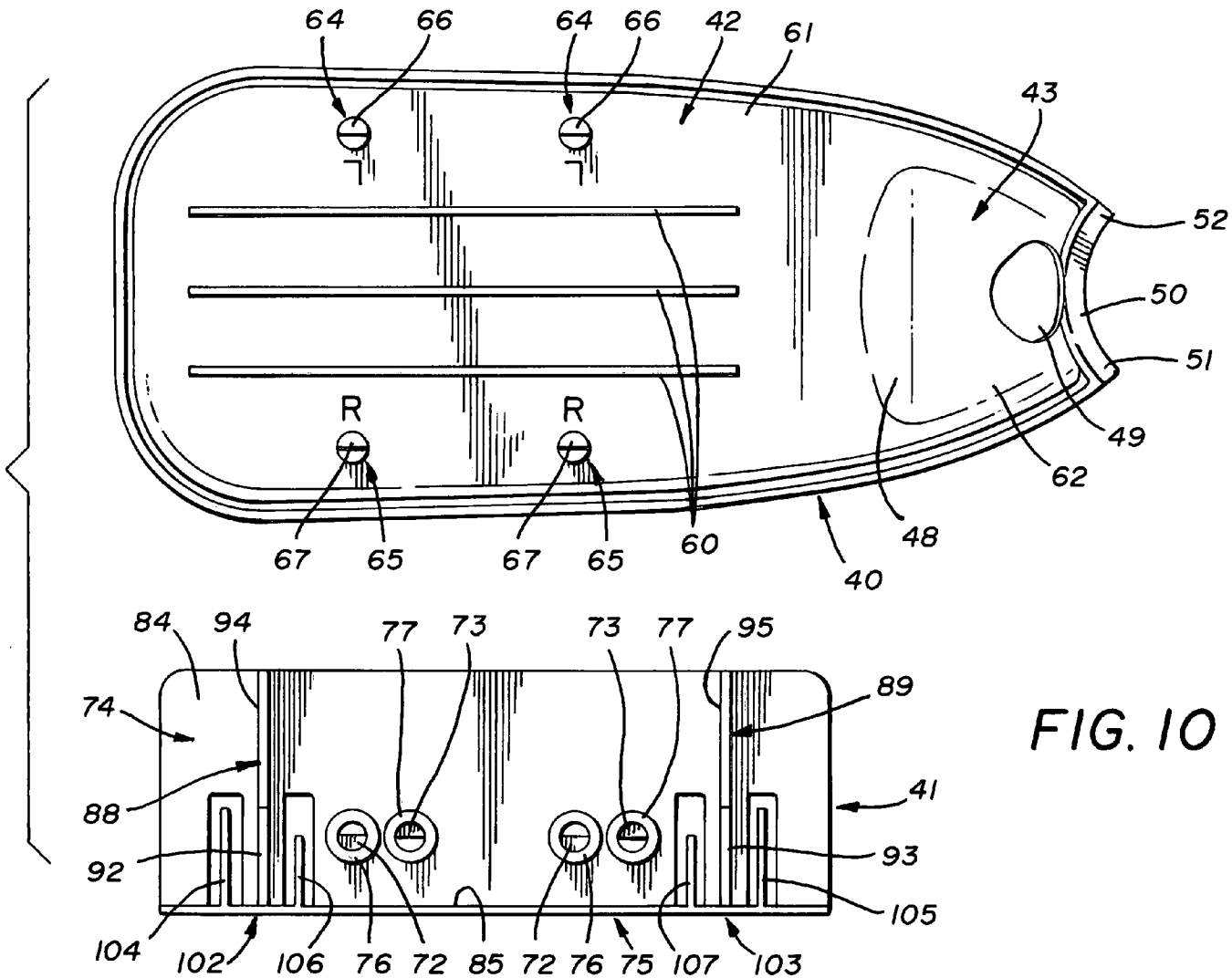
FIG. 10 is a bottom plan view of the mini-shelf unit and connecting bracket.

The half-circle shape of the individual holes of the sets of holes 72 and 73, and the half-circle shape of the individual nubs of the first and second connection nub pairs 66 and 67 in cross-section insure that, when in either a right-hand (hook on right) or a left-hand (hook on left) configuration, the mini-shelf unit 40 and the connecting bracket 41 are properly assembled. That is, the sets of holes 72 and 73, and the first and second connection nub pairs 66 and 67 insure that the mini-shelf unit 40 does not interfere with the wall surface on which the dispenser 20 is mounted, and that there is proper overhang of the hook portion 43 to the right or the left of the cover 25. For example, as seen in FIG. 10, the first pair of connection nubs 66 are labeled "L" referring to the right-hand configuration and the second pair of connection nubs 67 are labeled "R" referring to the left-hand configuration. Furthermore, as seen in FIG. 10, when the dispenser 20 is mounted on the wall surface, the first pair of connection nubs 66 can only be properly inserted into the set of holes 73, and the second pair of connection nubs 67 can only be properly inserted into the set of holes 72. Proper assembly of the mini-shelf unit 40 and connecting bracket 41 insures that the hook portion 43 is positioned the left or right of the cover 25 to provide clearance so that liquid drained through the hole 49 is poured away from the cover 25.

Figure 6:
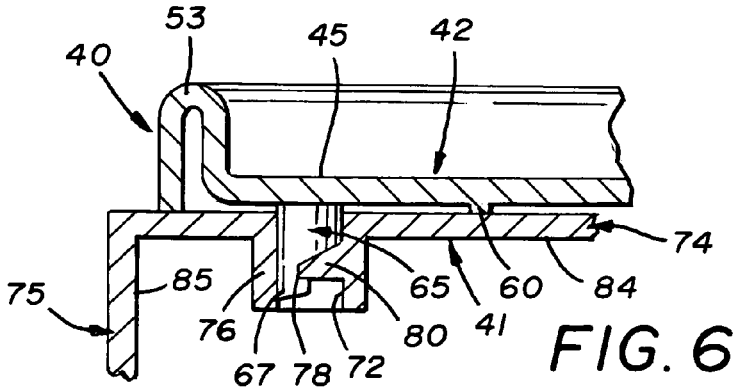
FIG. 6 is a cross-sectional view of the dispenser and mini-shelf unit along Line 6—6 of FIG. 4.

As seen in FIG. 6, the individual connection nubs are provided with notches 78, and the sets of holes 72 and 73 are adapted to the accommodate the notches 78. For example, closing off a portion of the sets of holes 72 and 73 to form the half-circle shape are sloped ledges 80. The inclines of the sloped ledges 80 are adapted to match the incline of the notches 78. Therefore, when the first connection nub pair 66 is inserted into set of holes 73, and the second connection nub pair 67 is inserted into set of holes 72, the interaction between the notches 78 and sloped ledges 80 releasably secure the mini-shelf unit 40 to the connecting bracket 41.

Figure 8:
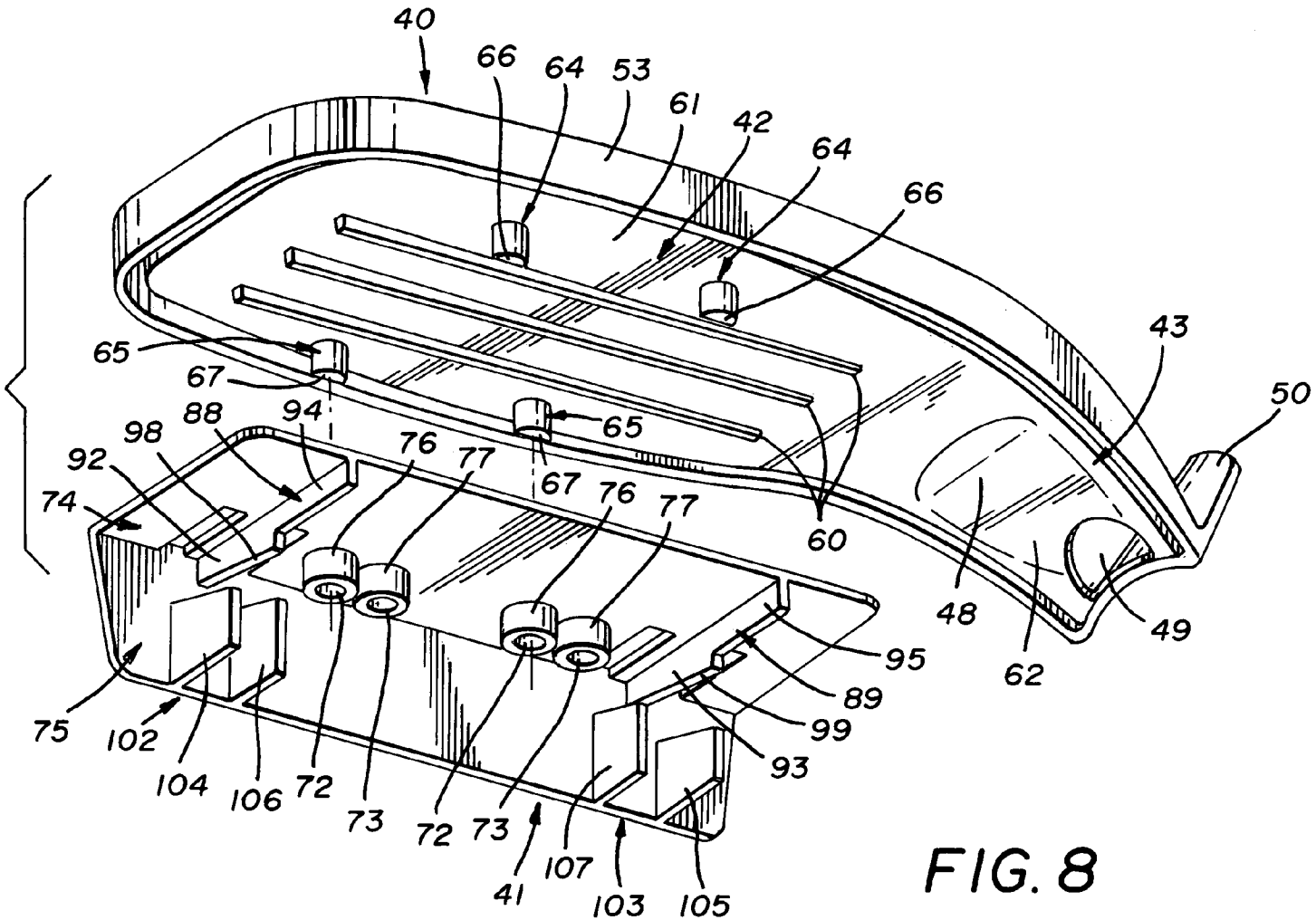
FIG. 8 is an exploded view of the mini-shelf unit and connecting bracket.

The mini-shelf unit 40 is attached to the connecting bracket 41, and the connecting bracket 41 is removably secured to the base mounting plate 21. As discussed above, and as seen in FIGS. 5 and 8, the connecting bracket 41 is L-shaped and is composed of the first leg member 74 and the second leg member 75 having interior surfaces 84 and 85, respectively. As seen in FIG. 8, the interior surface 84 is provided with stepped bracket ribs 88 and 89. Both stepped bracket ribs 88 and 89 are provided with first steps 92 and 93 and second steps 94 and 95. The first steps 92 and 93 have step surfaces 98 and 99, respectively, and these step surfaces are inclined with respect to the interior surface 84.

Figure 4:
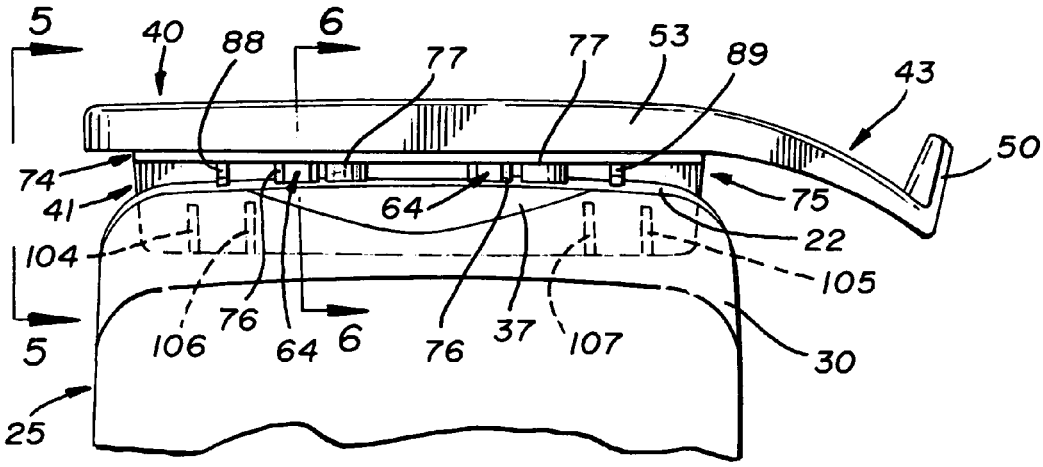
FIG. 4 is a front plan view of the mini-shelf unit as it is attached to the upper portion of the dispenser.
Figure 5:
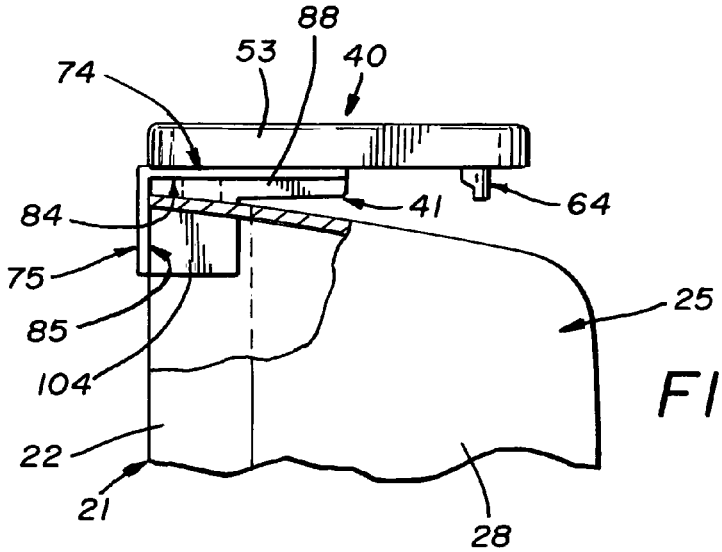
FIG. 5 is a cross-sectional view of the dispenser and mini-shelf unit along Line 5—5 of FIG. 4.

Extending outwardly from interior surface 85 are a first set and a second set of bracket extensions 102 and 103 as seen in FIG. 8. The first and the second sets of bracket extensions 102 and 103 each have peripheral extensions 104, 105 and central extensions 106, 107, respectively. The peripheral extensions 104, 105 extend outwardly farther from the interior surface 85 than the central extensions 106, 107, and the peripheral extensions 104, 105 are vertically offset from the central extensions 106, 107 to accommodate the contour of the upper portion of the side wall 22 of the base mounting plate 21. Furthermore, the distal end surfaces of the individual columns of the sets of columns 76 and 77 are also contoured to accommodate the upper portion of the side wall 22. As seen in FIGS. 4 and 5, the distances between the lower step surfaces 98, 99 and distal end surfaces of the individual columns, and the upper surfaces of the peripheral extensions 104, 105 and central extensions 106, 107 are adapted to accommodate the contour and thickness T of the upper portion of the side wall 22 of the base mounting plate 21. Ultimately, to secure the mini-shelf unit 40 and connecting bracket 41 to the base mounting plate 21, the first and second sets of bracket extensions 102 and 103 are inserted into channel C, and the upper portion of the side wall 22 is clamped between the lower step surfaces 98, 99 and distal end surfaces of the individual columns, and the upper surfaces of the peripheral extensions 104, 105 and central extensions 106, 107.

Thus, it should be evident that the IMPROVED LIQUID DISPENSER disclosed herein carries out one or more of the objects of the present invention set forth above and otherwise constitutes an advantageous contribution to the art. As will be apparent to persons skilled in the art, modifications can be made to the preferred embodiment's disclosed herein without departing from the spirit of the invention or the scope of the appended claims.

What is claimed is:

1. A dispenser securely mounted to a wall surface for dispensing fluid from a container, comprising:

A) a base mounting plate having a side wall;

B) a cover having a front fascia, wherein said cover is attached to said base mounting plate, and is capable of movement between open and closed positions relative to said base mounting plate;

C) a mini-shelf unit having a main body portion and a hook portion, said main body portion including a first top surface and said hook portion including a second top surface;

D) a hole provided in said second top surface;

E) a hook extending outwardly from the distal end of said hook portion;

F) a hump effectively segregating said first top surface and said second top surface, wherein said hump smoothly transitions into said second top surface; and G) a connecting bracket having an L-shape formed from a first leg member and a second member, wherein said mini-shelf unit is removably attached to said connecting bracket, and said connecting bracket is clamped to said side wall of said base mounting plate.

2. A dispenser according to claim 1, further comprising a rim extending around said mini-shelf unit, and first and second passages around the periphery of said hump, wherein said first passage and said second passage are used link said first top surface with said hole, and allow liquid received on said first top surface to be drained into said hole.

3. A dispenser according to claim 1, further comprising first and second pairs of posts, wherein said main body portion of said mini-shelf unit includes a first bottom surface, and said first pair and said second pair of posts extend outwardly from said first bottom surface.

4. A dispenser according to claim 3, further comprising two sets of holes provided in said first leg member, wherein one set of holes is adapted to accommodate said first pair of posts to orient said mini-shelf unit in a right-hand configuration with respect to said dispenser and the other set of holes is adapted to accommodate said second pair of posts to orient said mini-shelf unit in a left-hand configuration with respect to said dispenser.

5. A dispenser according to claim 4, wherein the distal ends of said first pair and said second pair of posts are respectively provided with first and second connection nub pairs, said first pair and said second pair of connection nubs having half-circle shapes in cross section.

6. A dispenser according to claim 5, wherein said two sets of holes have half-circle shapes matching said half-circles shapes of said first pair and said second pair of connection nubs, said half-circle shapes of one set of holes and said half-circle shapes of the other set of holes being oppositely oriented to insure proper positioning of said mini-shelf unit when said dispenser is mounted on the wall surface.

7. A dispenser according to claim 4, further comprising two sets of columns, wherein said connecting bracket includes first and second interior surfaces, said two sets of columns extend outwardly from said first interior surface, and said two sets of holes extend through said two sets of columns.

8. A dispenser according to claim 7, further comprising two stepped bracket ribs provided on said first interior surface of said connecting bracket, and first and second bracket extensions extending outwardly from said second interior surface.

9. A dispenser according to claim 8, wherein said side wall of said base mounting plate is inserted between said first and second bracket extensions, and said stepped bracket ribs and said two sets of columns to clamp said connecting bracket to said base mounting plate.

10. A dispenser according to claim 9, wherein the distal ends of the individual columns of said two sets of columns are adapted to accommodate the curvature of the said side wall.

11. A dispenser according to claim 9, wherein said first set and said second set of bracket extensions each include a center extension and a peripheral extension, said peripheral extensions being vertically offset from said center extension to accommodate the curvature of said side wall.

12. A dispenser according to claim 1, further comprising a locking mechanism including a latch and an articulable catch, wherein said articulable catch is operatively connected to said base mounting plate, and said articulable catch interfaces with said latch to effectively fasten said cover with respect to said base mounting plate.

13. A dispenser according to claim 1, further comprising two sight windows allowing the level of the fluid in the container to be determined, wherein said cover has a top surface, and said sight window is provided in said top surface, and the other sight window is provided in said front fascia.

14. A dispenser securely mounted to a wall surface for dispensing fluid from a container, comprising:

O) a base mounting plate having a side wall;

P) a cover having a front fascia divided into upper and lower front fascia portions, wherein said lower front fascia portion is provided with a sight window, and said cover is attached to said base mounting plate and is capable of movement between open and closed positions relative to said base mounting plate;

Q) a mini-shelf unit having a main body portion and a hook portion, said main body portion including a first top surface and said hook portion including a second top surface;

R) a hole provided in said second top surface;

S) a hook extending outwardly from the distal end of said hook portion;

T) a hump effectively dividing said first top surface and said second top surface, wherein said hump smoothly transitions into said second top surface;

U) a rim extending around said mini-shelf unit;

V) first and second passages around the periphery of said hump, wherein said first passage and said second passage are used link said first top surface with said hole, and allow liquid received on said first top surface to be drained into said hole; and W) a connecting bracket having an L-shape formed from a first leg member and a second member, wherein said mini-shelf unit is removably attached to said connecting bracket, and said connecting bracket is clamped to said side wall of said base mounting plate.

15. A dispenser according to claim 14, further comprising first and second pairs of posts, wherein said main body portion of said mini-shelf unit includes a first bottom surface, and said first pair and said second pair of posts extend outwardly from said first bottom surface.

16. A dispenser according to claim 15, further comprising two sets of holes provided in said first leg member, wherein one set of holes is adapted to accommodate said first pair of posts to orient said mini-shelf unit in a right-hand configuration with respect to said dispenser and the other set of holes is adapted to accommodate said second pair of posts to orient said mini-shelf unit in a left-hand configuration with respect to said dispenser.

17. A dispenser according to claim 16, wherein the distal ends of said first pair and said second pair of posts are respectively provided with first and second connection nub pairs, said first pair and said second pair of connection nubs having half-circle shapes in cross section.

18. A dispenser according to claim 17, wherein said two sets of holes have half-circle shapes matching said half-circles shapes of said first pair and said second pair of connection nubs, said half-circle shapes of one set of holes and said half-circle shapes of the other set of holes being oppositely oriented to insure proper positioning of said mini-shelf unit when said dispenser is mounted on the wall surface.

* * * * *